US009593439B2

(12) United States Patent
Kim

(10) Patent No.: US 9,593,439 B2
(45) Date of Patent: Mar. 14, 2017

(54) FREEZE PROTECTION METHOD FOR WASHING MACHINE

(71) Applicant: Dongbu Daewoo Electronics Corporation, Seoul (KR)

(72) Inventor: Ji Woo Kim, Anyang-si (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 384 days.

(21) Appl. No.: 14/080,628

(22) Filed: Nov. 14, 2013

(65) Prior Publication Data

US 2014/0158210 A1 Jun. 12, 2014

(30) Foreign Application Priority Data

Dec. 10, 2012 (KR) ..... 10-2012-0142483

(51) Int. Cl.
*D06F 33/02* (2006.01)
*D06F 39/08* (2006.01)

(52) U.S. Cl.
CPC ..... *D06F 39/081* (2013.01); *D06F 33/02* (2013.01); *D06F 39/08* (2013.01); *Y10T 137/0324* (2015.04)

(58) Field of Classification Search
CPC ..... D06F 39/081; D06F 39/082; D06F 33/02; A47L 15/421
USPC ..... 137/2; 68/13 R
See application file for complete search history.

(56) References Cited

PUBLICATIONS

KR 100725743 Machine Translation.*
JP 1986-280888 Machine Translation.*

* cited by examiner

*Primary Examiner* — Michael Barr
*Assistant Examiner* — Rita Adhlakha

(57) ABSTRACT

A freeze protection method for a washing machine includes: determining, by a control unit, whether or not laundry items exist after a washing process, when a freeze protection course is selected; determining, by the control unit, whether a freeze protection operation condition is satisfied or not, when no laundry items exist; and operating, by the control unit, a water supply device to supply water and operating a drain device to discharge water, when the freeze protection operation condition is satisfied; and returning to the determining of whether the freeze protection operation condition is satisfied or not, when a preset standby time passes after the water supply device and the drain device are operated.

10 Claims, 5 Drawing Sheets

FREEZE PROTECTION METHOD FOR WASHING MACHINE

CROSS-REFERENCES TO RELATED APPLICATIONS

The present application claims priority to Korean application number 10-2012-0142483, filed on Dec. 10, 2012, which is incorporated herein by reference in its entirety.

BACKGROUND OF THE INVENTION

The present invention relates to a freeze protection method for a washing machine, and more particularly, to a method for protecting a washing machine against freezing, which intermittently operates a water supply device and a drain device when a freeze protection operation condition is satisfied after a washing process, thereby preventing a water supply hose from freezing and bursting.

In general, washing machines may be classified into pulsator-type washing machines, agitator-type washing machines, and drum-type washing machines, depending on the washing method.

In pulsator-type washing machines, a rotatable pulsator installed at the bottom of a washing tub is rotated to generate a vortex of water, thereby spinning laundry items in the tub.

In agitator-type washing machines, when a washing rod called an agitator at the center of the washing tub is regularly rotated, an agitating wing at the side of the washing rod may generate water streams. Then, as the water streams cause laundry items to come in frictional contact with the washing rod and the wall of the washing tub, the laundry items are washed.

In drum-type washing machines, a horizontal cylindrical drum having a plurality of water holes therein is installed in a water storage tub. As the drum is rotated, laundry items are lifted to an upper space of the drum by a lifter within the drum, and then fall downward due to gravity. Such a process is repeated to wash the laundry items.

The pulsator-type washing machine removes various stains on clothes and bedclothes through emulsification of detergent, friction caused by water streams generated through rotation of the pulsator, and impact applied to laundry items by the pulsator.

The related art has been disclosed in Utility Model Registration No. 20-0392633 posted on Aug. 17, 2005 and titled "Anti-freeze water-supply and drain hose of washing machine.

In general, a washing machine may be installed at a place such as a veranda which is not heated, and a water supply hose generally does not retain heat. Thus, when the temperature rapidly decreases below zero, parts of the washing machine may freeze and burst. In this case, various problems may occur. For example, a user may suffer an economic loss or may not be able to use the washing machine.

SUMMARY OF THE INVENTION

Embodiments of the present invention are directed to a freeze protection method for a washing machine, which intermittently operates a water supply device and a drain device when a freeze protection operation condition is satisfied (e.g., after a washing process), thereby preventing a water supply hose from freezing and/or bursting.

In one or more embodiments, the method for protecting a washing machine from freezing includes determining, by a control unit, whether or not laundry items exist in the washing machine after a washing process, when a freeze protection course is selected; determining, by the control unit, whether a freeze protection operation condition is satisfied or not, when no laundry items exist in the washing machine; and supplying water from a water supply device and discharging water through a drain device when the freeze protection operation condition is satisfied; and determining again whether the freeze protection operation condition is satisfied or not a preset standby time after supplying the water and discharging the water.

Determining whether the freeze protection operation condition is satisfied or not may include receiving, by the control unit, the surrounding temperature from a temperature sensor; determining, by the control unit, whether or not a surrounding temperature is equal to or less than a preset temperature for a preset time; and determining, by the control unit, that the freeze protection operation condition is satisfied when the surrounding temperature is equal to or less than the preset temperature for at least the preset time.

Determining whether the freeze protection operation condition is satisfied or not may alternatively or additionally include determining, by the control unit, whether a preset operation time has arrived or not; comparing, by the control unit, a number of freeze protection operations to a preset number of repetitions, after the operation time has arrived; and determining, by the control unit, that the freeze protection operation condition is satisfied when the number of freeze protection operations does not exceed the preset number of repetitions.

The operation time may include a specific reserved time.

The operation time may include a periodic time for repetition.

DETAILED DESCRIPTION

Embodiments of the invention will hereinafter be described in detail with reference to the accompanying drawings. It should be noted that the drawings are not necessarily to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
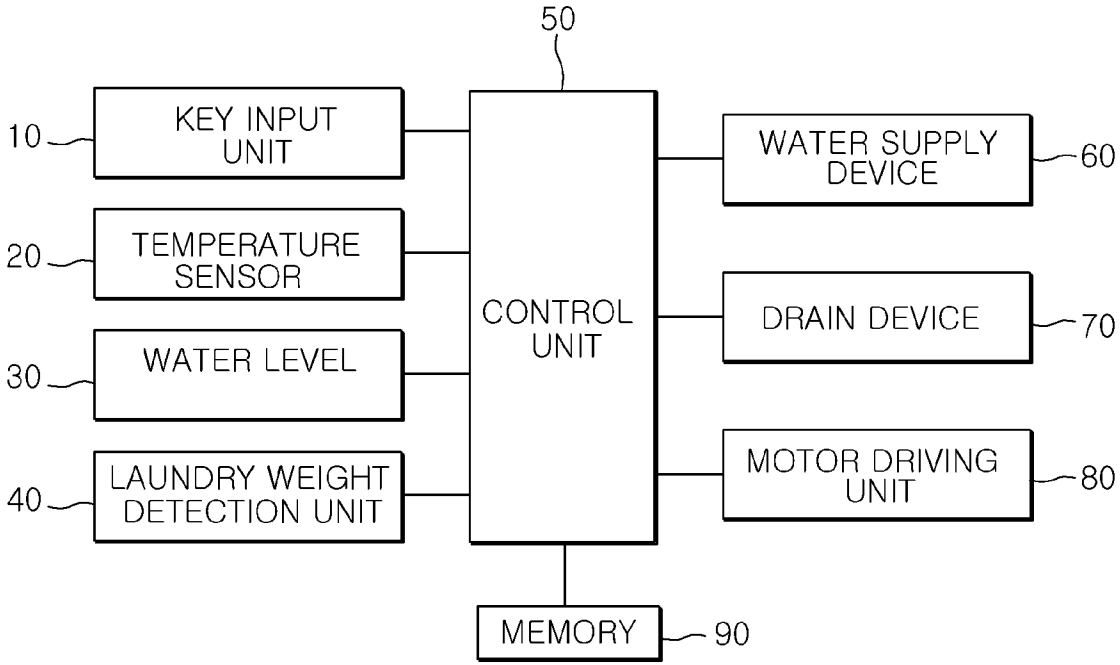
FIG. 1 is a block configuration diagram of an exemplary washing machine configured to perform a freeze protection method in accordance with one or more embodiments of the present invention.

FIG. 1 is a block configuration diagram of an exemplary washing machine configured to perform a freeze protection method in accordance with one or more embodiment(s) of the present invention.

Referring to FIG. 1, the washing machine in accordance with embodiment(s) of the present invention includes a memory 90 configured to store one or more system programs and information on various washing courses. Space in the memory 90 may be reserved for various washing process information. The washing machine further includes a control unit 50 configured to control overall operations of the washing machine. The control unit 50 receives information regarding a selected washing course from a key input unit 10 on the washing machine (including, for example, washing machine setting conditions based on the selected washing course), and the washing machine performs a washing process in response to signals from the control unit 50.

When the washing process is performed, the control unit 50 operates a water supply device 60 to supply wash water to the tub of the washing machine, while sensing the water level of the wash water in the tub using a water level sensor 60, according to a water level which is set on the basis of the weight of laundry items, detected by a laundry weight detection unit 40. Then, the control unit 50 operates a motor driving unit 80 to perform a washing process, a rinsing process, and a spin-drying process. When the washing process is completed, the control unit 50 operates a drain device 70 to discharge the wash water.

Furthermore, when a freeze protection course is selected, the control unit 50 receives the surrounding temperature from a temperature sensor 20 (e.g., after the washing process ends). When a freeze protection operation condition is satisfied, the control unit 50 operates the water supply device 60 and the drain device 70 to prevent a water supply hose from freezing and/or bursting.

Figure 2:
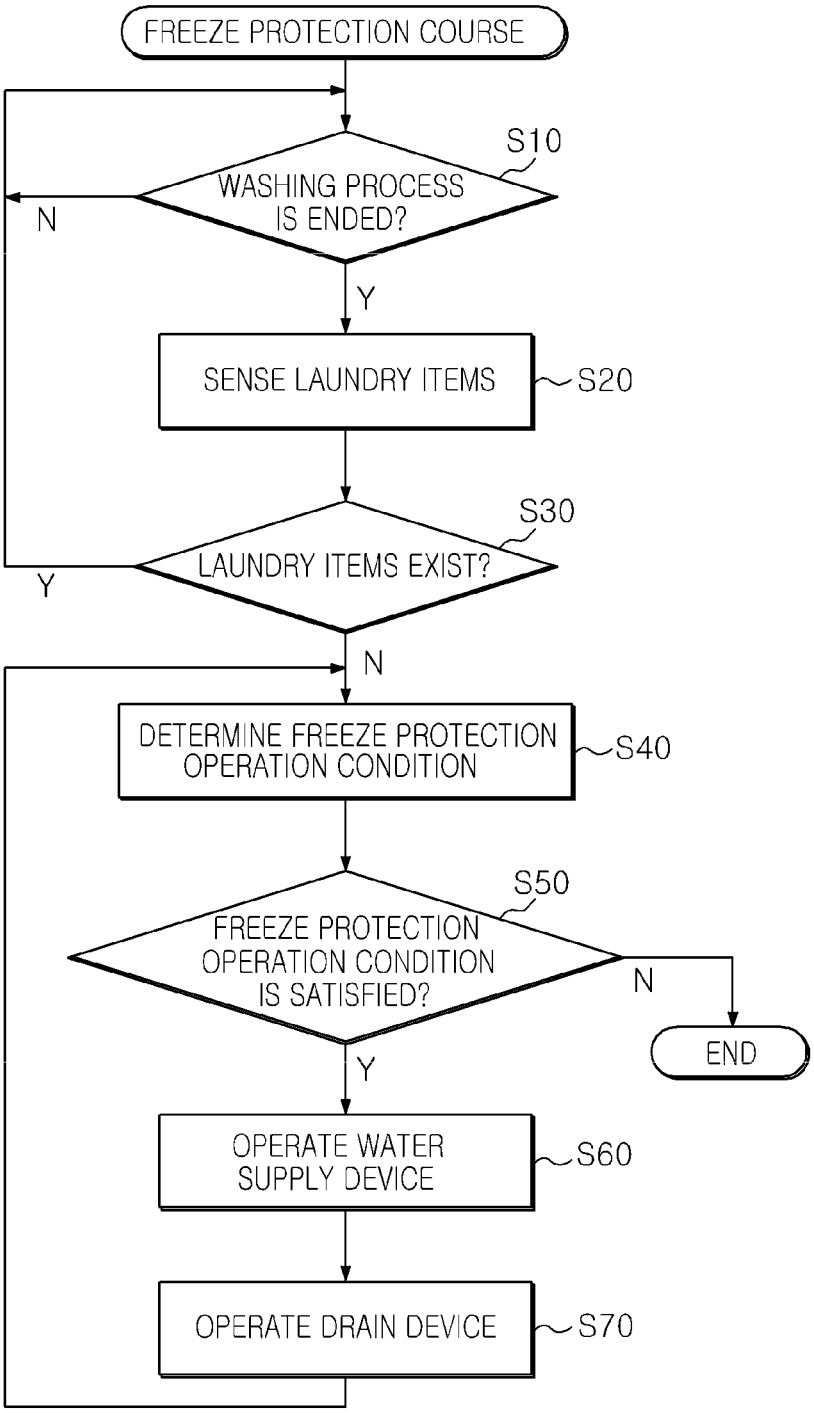
FIG. 2 is a flowchart for explaining an exemplary freeze protection method for a washing machine in accordance with embodiment(s) of the present invention.
Figure 3:
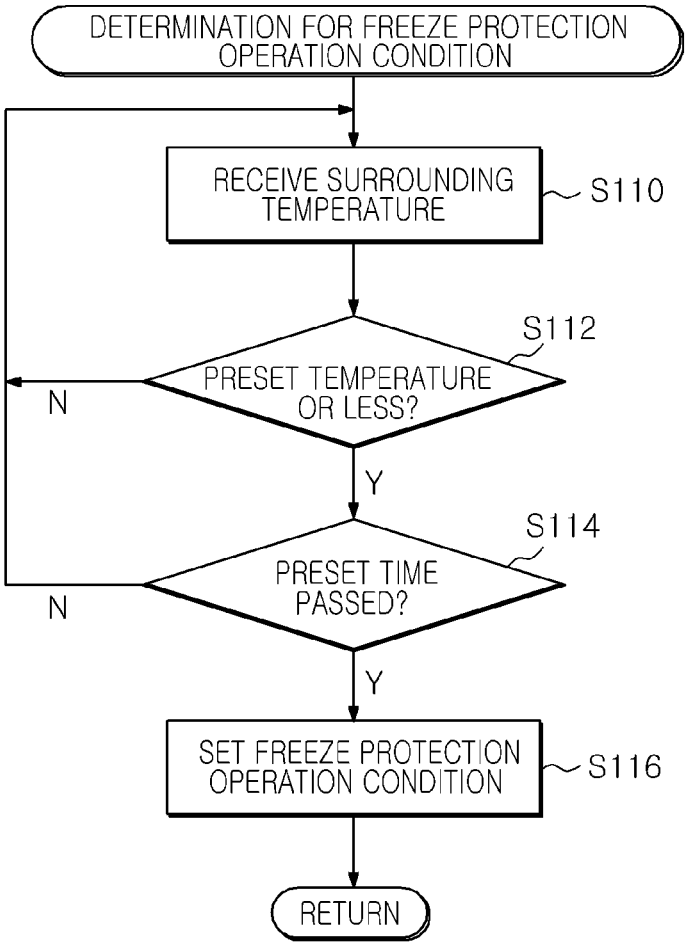
FIG. 3 is a flowchart for explaining an exemplary process of determining whether or not a freeze protection operation condition is satisfied in the freeze protection method for a washing machine in accordance with embodiment(s) of the present invention.
Figure 4:
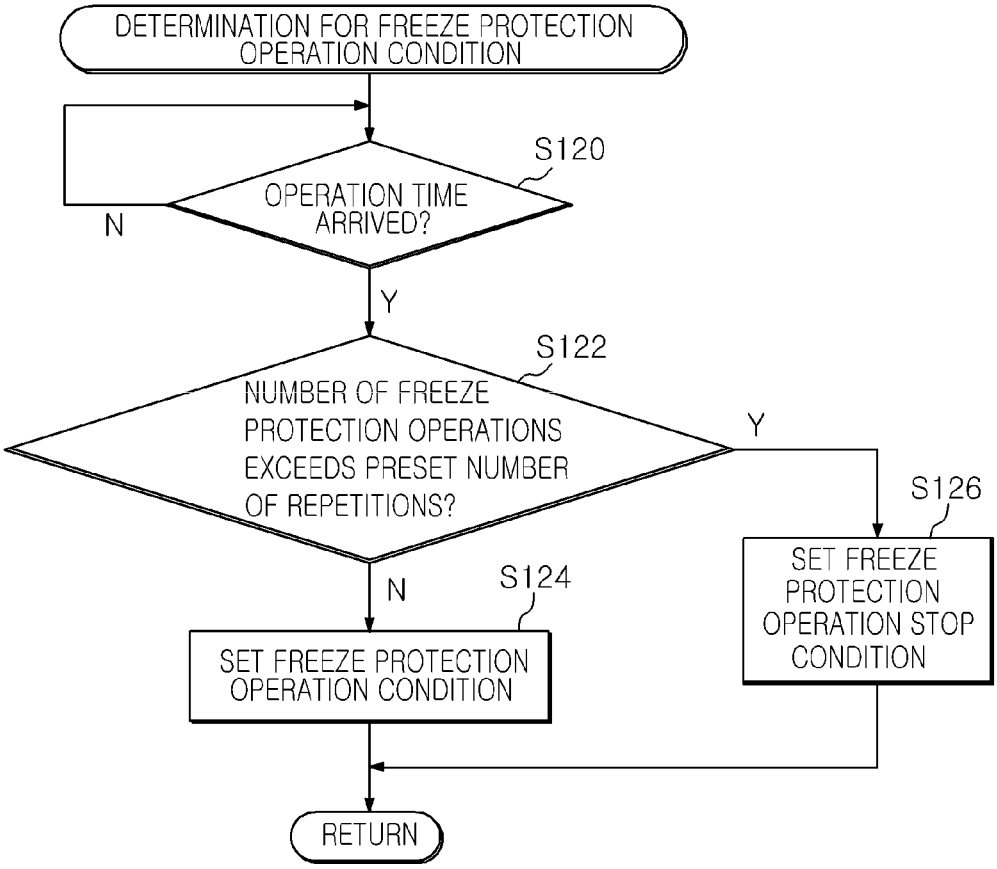
FIG. 4 is a flowchart for explaining another example of the process of determining whether or not a freeze protection operation condition is satisfied in the freeze protection method for a washing machine in accordance with embodiment(s) of the present invention.
Figure 5:
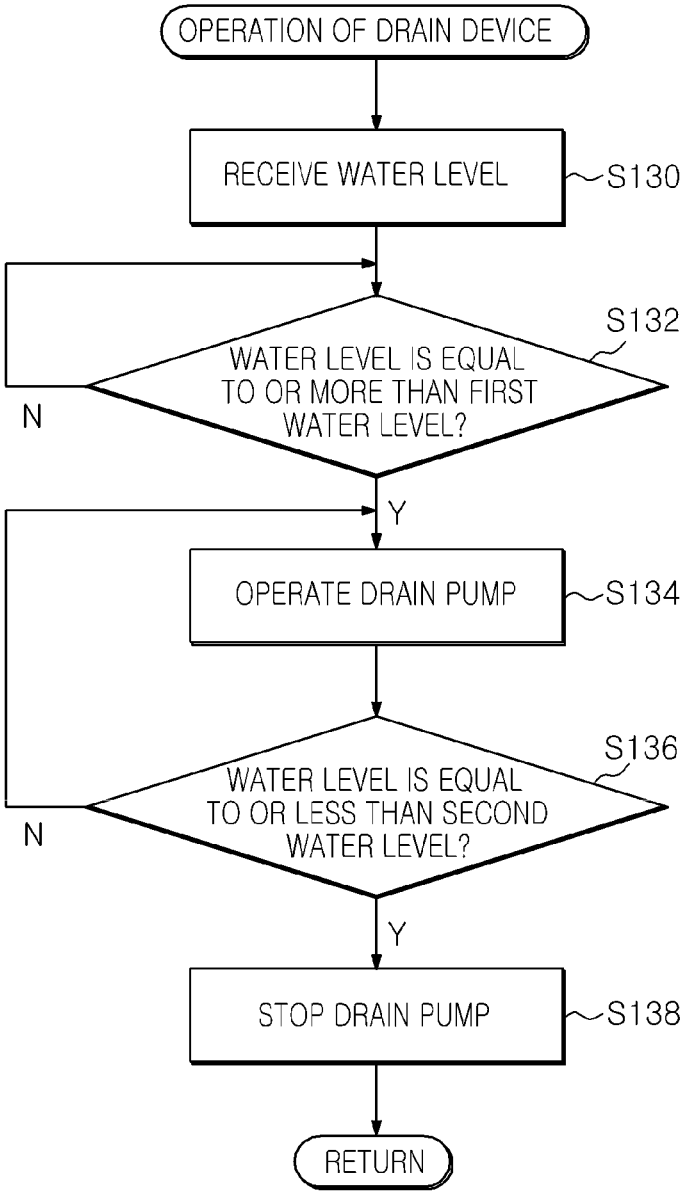
FIG. 5 is a flowchart for explaining an exemplary operation of the drain device in the freeze protection method for a washing machine in accordance with embodiment(s) of the present invention.

FIG. 2 is a flowchart for explaining an exemplary freeze protection method for a washing machine in accordance with embodiment(s) of the present invention. FIG. 3 is a flowchart for explaining an exemplary process of determining whether or not a freeze protection operation condition is satisfied in the freeze protection method in accordance with embodiment(s) of the present invention. FIG. 4 is a flowchart for explaining another example of the process of determining whether or not a freeze protection operation condition is satisfied in the exemplary freeze protection method in accordance with embodiment(s) of the present invention. FIG. 5 is a flowchart for explaining an exemplary operation of the drain device in the freeze protection method for a washing machine in accordance with embodiment(s) of the present invention.

An exemplary freeze protection method for a washing machine in accordance with embodiment(s) of the present invention will be described with reference to FIG. 2. First, when a freeze protection course is selected, the control unit 50 determines whether a washing process has ended or not, at step S10.

When the washing process has ended, the control unit 50 senses the presence or absence of laundry items in the washing machine (e.g., in the tub), and determines whether the laundry items exist or not (e.g., in the washing machine or the tub), at steps S20 and S30.

In general, the freeze protection operation for operating the water supply device 60 to protect the water supply hose from freezing and bursting is performed only when no laundry items exist (e.g., in the washing machine or the tub).

When determining that no laundry items exist (e.g., in the washing machine or the tub), the control unit 50 determines whether a freeze protection operation condition is satisfied or not, at step S40.

The freeze protection operation condition may be set or defined in various manners. For example, when a preset time passes after the surrounding temperature as sensed by the temperature sensor 20 is equal to or less than a freezing temperature, the freeze protection operation may be performed. Alternatively, the freeze protection operation may comprise a preset number of repetitions at or during a reserved time, or may comprise periodically performing a preset number of repetitions, without the temperature sensor 20 or use of any temperature data/information from the temperature sensor 20.

Referring to FIG. 3, the control unit 50 receives the surrounding temperature (e.g., an electrical signal representing the surrounding temperature) from the temperature sensor 20, in order to determine the freeze protection operation condition according to the surrounding temperature, at step S110.

When the surrounding temperature is equal to or less than a preset temperature, the control unit 50 determines whether or not a preset time has passed in which the surrounding temperature is equal to or less than the preset temperature, at steps S112 and S114. For example, the preset temperature may be 0° C., −2° C., −3° C., −4° C., −5° C., etc., depending on the design of the washing machine, the quality of the water supply, etc. The preset temperature may set or selected at the factory, at a distributor or point of sale, and/or by the user. Typically, the preset temperature is from 0° C. to −3° C. The preset time may be from 1 minute to 1 hour, or any value or range of values therein (e.g., from 3 minutes to 30 minutes, 5 minutes to 15 minutes, 10 minutes, etc.), and can be set or selected at the factory, at a distributor or point of sale, and/or by the user.

When the surrounding temperature has been equal to or less than the preset temperature for at least the preset time, the freeze protection operation condition is set or satisfied at step S116.

As such, the control unit 50 may receive the surrounding temperature information from the temperature sensor 20, count the amount of time that the surrounding temperature remains at or below a freezing temperature, substantially or figuratively predict a freezing state according to the surrounding temperature and time, and perform the freeze protection operation.

Referring to FIG. 4, the control unit 50 may determine the freeze protection operation condition based on an operation time, set or entered using the key input unit 10.

That is, the control unit 50 determines whether a preset operation time has arrived or not at step S120.

The operation time may include a reserved time or periodic time for repetition.

For example, when the reserved operation time is set or programmed to 2:00 AM, the control unit 50 determines whether it is 2:00 AM or not. However, when the periodic time for repetition is set or programmed to four hours, the control unit 50 counts the time after a washing process, and determines whether four hours has passed or not. The user may adjust or vary the operation time and/or the periodic time depending on current or predicted weather conditions. For example, the colder the weather conditions, the earlier the operation time should be (e.g., midnight, 11:00 PM, 10:00 PM, 9:00 PM, etc.), and/or the more frequent the periodic time should be (e.g., 2 hours, 1 hour, etc.). In an extreme case, the periodic time can be set or programmed for continuous operation.

When the operation time arrives, the control unit 50 compares the number of freeze protection operations to the number of repetitions, at step S122.

When the freeze protection operation is programmed using the key input unit 10, the number of repetitions may be set. Thus, when the freeze protection operation is performed at the operation time, the freeze protection operation may comprise the number of repetitions (e.g., of supplying water to the tub of the washing machine and draining or discharging the water from the tub). The number of repetitions can be any positive integer (e.g., of 1 or more), and can be determined empirically. For example, the number of repetitions may be adjusted or varied depending on current or predicted weather conditions and/or the operation time. In general, the colder the weather conditions and/or the earlier the operation time, the greater the number of repetitions (e.g., 3, 4, 5, 6, etc.). In an extreme case, the number of repetitions can be set or programmed to an infinite number (i.e., continuous operation).

Thus, the control unit 50 determines whether or not the number of repetitions of the freeze protection operation were performed since the operation time.

When the number of repetitions of the freeze protection operation since the operation time have not yet been performed, the freeze protection operation condition is set (or satisfied) at step S124, and when the number of repetitions of the freeze protection operation since the operation time have been performed, a freeze protection operation stop condition is set (or satisfied) at step S126.

When the freeze protection operation condition is satisfied, the control unit 50 operates the water supply device 60 (e.g., supplies water to the tub of the washing machine) and the drain device 70 (e.g., drains or discharges water from the tub), in order to prevent the wash supply hose from freezing and/or bursting, at steps S60 and S70.

The control unit 50 turns on a cold water valve (not illustrated), a hot water valve (not illustrated), and a conditioner valve (not illustrated) for a predetermined period of time (e.g., from 1 second to 1 minute, or any value or range of values therein, such as 2 seconds to 10 second, three seconds, etc.) so that the water supply device 60 supplies water to the tub, and then turns off the valves.

In the present disclosure, the cold water valve, the hot water valve, and the conditioner valve are merely examples for description. However, any water supply control valve may be turned on and off as needed or desired (e.g., as programmed) to prevent any water supply hose (not illustrated) from freezing and bursting. In one embodiment, the control unit 50 may turn on and off all of the valves to prevent the water supply hose from freezing and/or bursting. In another embodiment, the control unit 50 may turn on and off the valves connected to uninsulated or non-insulated water supply hoses (e.g., hoses supplying cold water) to prevent the uninsulated or non-insulated water supply hoses from freezing and/or bursting.

When the water supply device 60 supplies water, the drain device 70 is also operated to discharge water.

In one embodiment, the drain device 70 is configured on the basis of (e.g., to perform) a natural drainage method. In such an embodiment, the control unit 50 may open a drain valve (not illustrated) while operating (or to operate) the drain device 60. Thus, water may be discharged from the washing machine as the water is supplied into the washing machine.

However, when the drain device 70 includes a drain pump (not illustrated), the control unit 50 may receive the level or amount of water supplied (e.g., to the tub) from the water level sensor 30 at step S130, as illustrated in FIG. 5.

When the level of supplied water is equal to or more than a first level, the control unit 50 operates (e.g., turns on) the drain pump to discharge water, at steps S132 and S134.

Then, when the level of the supplied water is equal to or less than a second level, the control unit 50 stops the drain pump to stop discharging water, at steps S136 and S138. The second level is generally less than the first level.

The second level may correspond to a level at which an impeller (not illustrated) of the drain pump sinks under the water in the drain pump. When the impeller is exposed, noise from the pump may increase. Thus, to reduce or minimize noise, the control unit 50 may stop the drain pump at a level where the impeller sinks under water.

When the freeze protection operation condition is satisfied and the water supply device 60 and the drain device 70 are operated, the control unit 50 may determine whether the freeze protection operation condition is satisfied again, after a preset standby time passes (see, e.g., steps S70 and S40 in FIG. 2). The preset standby time may be from 1 minute to 4 hours, or any value or range of values therein, depending on current and/or predicted weather conditions, the programming at the factory, distributor or point of sale, or by the user, etc. Then, the control unit 50 repeats the freeze protection operation until the number of repetitions is satisfied. Additionally or alternatively, the freeze protection operation and/or the freeze protection course may be ended when the surrounding temperature is above the preset temperature (and optionally, for a preset length of time), when the user operates the washing machine (e.g., performs a washing operation on laundry in the washing machine), or when the user cancels the freeze protection operation and/or the freeze protection course.

In the freeze protection method for a washing machine in accordance with embodiment(s) of the present invention, when the freeze protection operation condition is satisfied, the control unit may intermittently operate the water supply device and the drain device and prevent the water supply hose from freezing and/or bursting in the winter time. Therefore, it is possible to prevent leakage and/or damage caused by freezing and/or bursting of various washing machine parts (e.g., water supply hoses) and reduce the cost or replacing damaged or broken parts, thereby increasing users' convenience and satisfaction.

Embodiments of the present invention have been disclosed above for illustrative purposes. Those skilled in the art will appreciate that various modifications, additions and substitutions are possible, without departing from the scope and spirit of the invention as disclosed in the accompanying claims.

What is claimed is:

1. A method for protecting a washing machine from freezing, comprising:

selecting a freeze protection course;

determining, by a control unit, that there are no laundry items that exist after a washing process;

determining, by the control unit, that a freeze protection operation condition is satisfied;

supplying water from a water supply device and draining or discharging water using a drain device; and determining again that the freeze protection operation condition satisfied a preset standby time after supplying the water and draining or discharging the water, wherein determining that the freeze protection operation condition is satisfied comprises:

determining, by the control unit, that a preset operation time has arrived;

comparing, by the control unit, a number of freeze protection operations to a preset number of repetitions; and determining, by the control unit, that the freeze protection operation condition is satisfied when the number of freeze protection operations does not exceed the preset number of repetitions.

2. The method of claim 1, wherein determining that the freeze protection operation condition is satisfied comprises comparing a surrounding temperature to a preset temperature.

3. The method of claim 2, wherein determining that the freeze protection operation condition is satisfied comprises:

receiving, by the control unit, the surrounding temperature from a temperature sensor;

determining, by the control unit, whether or not the surrounding temperature is equal to or less than the preset temperature for a preset time; and determining, by the control unit, that the freeze protection operation condition is satisfied when the surrounding temperature is equal to or less than the preset temperature for at least the preset time.

4. The method of claim 1, further comprising determining, by the control unit, that a freeze protection operation stop condition is satisfied when the number of freeze protection operations equals or exceeds the number of repetitions.

5. The method of claim 1, wherein the preset operation time is a specific reserved time.

6. The method of claim 1, wherein the preset operation time comprises a preset periodic time after completing the washing process.

7. The method of claim 1, wherein supplying the water comprises turning on one or more of a cold water valve, a hot water valve, and a conditioner valve for a preset time period, and draining or discharging the water comprises opening a drain valve.

8. The method of claim 7, further comprising turning off the one or more valves after the preset time period passes.

9. The method of claim 1, wherein draining or discharging the water comprises:

receiving, by the control unit, a level of supplied water from a water level sensor;

comparing, by the control unit, the supplied water level to a first water level; and operating, by the control unit, the drain device to discharge water when the supplied water level is equal to or more than the first water level.

10. The method of claim 9, wherein operating the drain device further comprises:

comparing, by the control unit, the supplied water level to a second water level less than the first water level; and stopping the drain pump when the supplied water level is equal to or less than the second water level.

* * * * *